United States Patent [19]

Neyret

[11] 4,060,202

[45] Nov. 29, 1977

[54] VALVE FOR GAS LIGHTER

[75] Inventor: Guy Neyret, Francheville, France

[73] Assignee: Societe Anonyme dite: Etablissement Genoud & Cie, Venissieux, France

[21] Appl. No.: 692,730

[22] Filed: June 4, 1976

[30] Foreign Application Priority Data

June 5, 1975 France ..... 75.18162

[51] Int. Cl.[2] ..... F23D 13/04

[52] U.S. Cl. ..... 239/579; 431/344

[58] Field of Search ..... 239/579; 431/130, 131, 431/142, 143, 150, 254, 255, 276, 277, 344

[56] References Cited

U.S. PATENT DOCUMENTS 3,860,385 1/1975 Nakahishi ..... 431/344

3,961,876 6/1976 Chernock ..... 431/344

3,989,445 11/1976 Kojima ..... 431/344 X

*Primary Examiner*—Evon C. Blunk

*Assistant Examiner*—Michael Mar

*Attorney, Agent, or Firm*—Karl F. Ross

[57] ABSTRACT

A valve for a gas lighter wherein an elongated support body of low thermal conductivity is clamped in a tubular member forming a valve seat at its upper end to lock a flame-height-controlling filter in place below this valve seat. The improvement resides in the formation of the thermally conductive burner-carrying member with a tubular apron, skirt or sleeve which is fitted over the thermally conductive valve member and slidingly guided therein to press a valve body (rubber gasket or flap valve) against the valve seat. The gas passage in the burner member is formed only in the upper end thereof, while the apron extends into the well beyond the filter.

10 Claims, 1 Drawing Figure

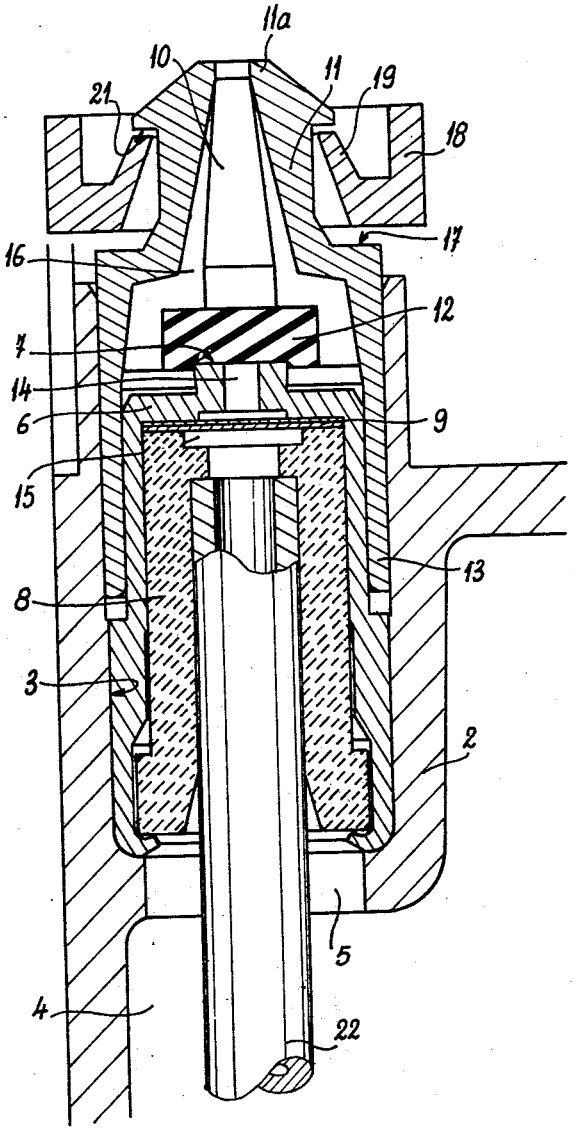
11a
10
11
19
21
18
17
16
12
7
14
6
9
15
13
8
3
2
5
4
22

VALVE FOR GAS LIGHTER

FIELD OF THE INVENTION

The present invention relates to a valve for a gas lighter and, more particularly to a valve for a lighter of the disposable type.

BACKGROUND OF THE INVENTION

Gas lighters, whether or not of the disposable type, are generally equipped with a burner-valve member mounted to slide vertically in the valve body under the action of a lever for controlling the opening and closing of the valve member, with a gasket integral with the burner-valve member, with a valve body forming a valve member seat, with a pressure-regulating filter and with a support member for this filter fitted in the valve body. This burner-valve member is thus a tubular part which is quite long to ensure that it is correctly guided in the valve body.

Since the channel for the passage of gas has a relatively small diameter, this burner-valve member, which may be manufactured by cutting out or molding, creates fabrication problems owing to the difficulty in stripping it from the spindle serving as a core, from which results low productivity.

OBJECT OF THE INVENTION

The present invention intends to remedy this drawback while facilitating automation of the assembly operations, so as to reduce the cost of these lighters.

SUMMARY OF THE INVENTION

To this end, in the valve to which it relates, the filter-support member and valve body in which the filter-support member is fitted with the interposition of said filter, are constituted by concentric tubular parts and, beyond the valve gasket, the burner-valve member comprises a cylindrical skirt engaged and sliding on the valve body, which serves as a guide for the latter.

Owing to this arrangement, the length of the burner-valve member may be considerably reduced in the same manner as the length of the gas-outlet channel of the burner-valve member, which considerably reduces the cost of this part.

It should be noted that the large-diameter shoulder formed below the burner by the cylindrical skirt of the burner-valve member constitutes a large support surface for the lever controlling the valve member, which makes it possible to provide a lever of larger dimensions and consequently one which is less expensive for the same mechanical strength.

Furthermore, it will be noted that assembly by stacking the four parts constituting the valve, as well as fitting the filter and filter support member in the body of the valve, require solely a repetition of the same vertical movements which greatly facilitates automation of this operation.

Advantageously, the filter-support member, located upstream of the latter, is made from a material which is a nonconductor or poor conductor of heat, whereas the valve body and burner-valve member are made from a material which is a good heat conductor in order to ensure a good heat transfer from the burner to the gas-evaporation chamber located downstream of the filter and thus promote evaporation of the liquefied gas.

According to another feature of the invention, also facilitating the manufacture of the burner-valve member, the gas-outlet channel has a substantially frustoconical profile, the small end being located adjacent the burner and the large end adjacent the gasket, retention of the latter being ensured by radial fins between which passages for the gas are provided.

It has been mentioned above that, owing to the shape of the burner-valve member, it is possible to provide a lever of large dimensions. According to yet another feature of the invention, a flexible lip able to be engaged by force and displaced axially on the burner is provided in the part of the lever which surrounds the burner.

Thus, the movement for assembling the lever is also a simple vertical movement.

Preferably, the distance between the radial fins supporting the gasket and the upper side of the valve body is such that the former may be brought into contact with the latter after slight crushing of the gasket constituting the flap valve. This arrangement facilitates rigid support of the burner-valve member on the valve body during assembly of the lever for controlling the valve member.

BRIEF DESCRIPTION OF THE DRAWING

The invention will be better understood by means of the ensuing description referring to the accompanying diagrammatic drawings, whereof the sole FIGURE shows a embodiment of this valve in axial section.

SPECIFIC DESCRIPTION

Provided in the body or housing 2 of a gas lighter is a hole or well 3 intended to receive the valve and connected to the reservoir 4 by an opening 5.

According to the invention, the valve body 6 in the upper side of which is provided the flap-valve seat 7 and the part 8 fitted in the body with interposition of the pressure-regulating filter 9, are concentric tubular parts.

Furthermore, the burner-valve member 11 whose outer end **11*a* constitutes the burner proper and whose inner end supports the flap valve 12 is provided, beyond the flap valve 12, with a cylindrical skirt 13 whose inner diameter is intended to facilitate its sliding engagement on the valve body 6** which serves to guide the latter during its axial movement for opening and closing the valve.

Owing to this arrangement, the distance between the flap valve 12 and the burner part **11*a* of the burner-valve member 11** may be considerably reduced, since guidance of said burner-valve member is ensured by a cylindrical extension independent of this distance.

Consequently, it is no longer necessary to provide a gas outlet channel 10 of great length which, taking into account its small section, was difficult to produce.

Since the burner-valve member 11 is machined or molded, its cost price is thus considerably reduced.

To ensure good transfer of heat from the burner **11*a* to the evaporation chamber 14 located downstream of the filter 9 and thus to facilitate the evaporation of the liquefied gas, the burner 11*a* and its tubular extension 13** are made from a good heat conducting material.

Conversely, in order to reduce the risks of evaporation of the liquefied gas in the moistening chamber 15 located immediately upstream of the filter 9, the support member 8 for the latter is made from a material which is a nonconductor or poor conductor of heat.

According to another feature of the invention, the flap valve 12 is retained by radial fins 16, between which are provided passages for the gas released by the filter 9.

As is clear from the drawing, the tubular extension 13 of the burner-valve member 11 forms a large diameter shoulder 17 below the head 11*a* of the burner the shoulder being engageable by a lever 18 for controlling the opening and closing of the valve member, which lever has large dimensions and consequently is of low cost.

According to yet another feature of the invention made possible by the large dimensions of the lever 18, the part of the latter which surrounds the burner 11*a* and which may be produced by a circular cut out or an end cut out is constituted by a flexible lip 19 able to be forced over the head 11*a* of the burner and to then engage under the shoulder 21 of the latter, on which the lip 19 bears during the operation of the lever 18 in the direction of raising the flap valve 12.

It will be apparent that all the operations for assembling the parts constituting this valve involve vertical movements for the engagement of the valve body 6 on the support member 8, for the fitting of these two parts, for the engagement of the burner-valve member 11 on the valve body 6 and for the assembly of the lever 18 on the burner-valve member 11. This considerably simplifies the automation of assembly.

To facilitate assembly of the lever 18 on the burner-valve member 11, by creating a rigid support for the latter, the distance between the radial fins 16 and the upper side of the valve body 6 is such that the former may be brought into contact with the latter after slight crushing of the flexible gasket constituting the flap valve 12.

Furthermore, it may be noted that the tubular shape of the support member 8 is utilized for the assembly of the plunger tube 22.

It may also be noted that as the filter 9 can be a porous membrane such as that described in my concurrently filed patent application Ser. No. 692,729.

Naturally, the invention is not limited to the single embodiment of this valve which was described above as a non-limiting example. On the contrary, it includes all variations.

I claim:

1. A valve for a gas lighter comprising:

a housing formed with a well communicating with a fuel reservoir;

an axially elongated tubular valve member received in said well and having one end anchored therein and another end formed with a valve seat surrounding an orifice;

a tubular filter-support member received in said valve member and coaxial therewith;

a pressure-regulating filter clamped between said members for regulating the flow of gaseous fuel through said orifice;

an elongated burner member formed at one end with a burner nozzle and a passage communicating between said orifice and said nozzle, and at its opposite end with an elongated cylindrical skirt slidingly engaging the exterior of said valve member; and a valve body on said burner-member engageable with said seat for blocking flow from said orifice to said passage, said passage extending only over a portion of the length of said burner-member.

2. The valve defined in claim 1 wherein said filter-support member is rigid and composed of a material of poor thermal conductivity to limit transmission of heat to said reservoir, the other members being of high thermal conductivity.

3. The valve defined in claim 2, further comprising a duct lodged in said filter-support member and communicating with said reservoir for delivering fuel therefrom to said orifice.

4. The valve defined in claim 2 wherein said passage has a substantially frustoconical shape with a small end at said nozzle and a large end at said body, said burner member being formed internally adjacent said large end of said passage with radial fins engaging said body and defining between them passageways for the gaseous fuel.

5. The valve defined in claim 4 wherein said nozzle is formed with a frustoconical external periphery terminating in a shoulder said valve further comprising an actuating lever having an inwardly converging lip deflectable upon being pressed over said nozzle for resilient engagement behind said shoulder.

6. The valve defined in claim 4 wherein the distance between the radial fins engaging said body and said seat is such that said body is brought into contact with said seat after a slight crushing thereof.

7. The valve defined in claim 4 wherein said filter-support member is received wholly in said valve member and said valve member has an inwardly turned rim at its said other end engaging behind said filter-support member, said filter-support member receiving a tube connecting it with said reservoir, said filter being axially engaged between an inner surface at the said one end of said valve member and an end face of said filter-support member remote from said reservoir, said body constituting a flap valve gasket anchored in said fins and said nozzle being tapered away from said well and having an annular shoulder, said valve further comprising a lever being formed with an inwardly converging frustoconical lip resiliently deflectible upon being thrust over said nozzle to engage behind said shoulder.

8. The valve defined in claim 7 wherein said gasket is composed of an elastomer.

9. The valve defined in claim 7 wherein said support member is composed of a ceramic or a synthetic resin.

10. The valve defined in claim 7 wherein said valve member and said burner members are metallic.

* * * * *